US006210231B1

(12) United States Patent
Lai

(10) Patent No.: US 6,210,231 B1
(45) Date of Patent: Apr. 3, 2001

(54) ELECTRICAL CONNECTOR

(75) Inventor: Chin-Te Lai, Tao-Yuan (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/451,193

(22) Filed: Nov. 29, 1999

(51) Int. Cl.[7] ..... H01R 13/648
(52) U.S. Cl. ..... 439/610; 439/606
(58) Field of Search ..... 439/610, 607, 439/609, 606

(56) References Cited

U.S. PATENT DOCUMENTS 5,683,269 * 11/1997 Davis et al. ..... 439/607
5,938,476 * 8/1999 Wu et al. ..... 439/610
5,944,559 * 8/1999 Wu ..... 439/607
5,961,351 * 10/1999 Wu ..... 439/610
6,039,606 * 3/2000 Chiou ..... 439/610

* cited by examiner

*Primary Examiner*—Gary F. Paumen
(74) *Attorney, Agent, or Firm*—Wei Te Chung

(57) ABSTRACT

An electrical connector of the present invention comprises an insulative housing, a plurality of contacts received in the housing, a unitary shell enclosing the housing and the contacts therein and an insulative cover partially enclosing the shell. The housing includes a body portion and a tongue portion protruding beyond a first face of the body portion. The unitary shell includes a first shielding portion and a second shielding portion connected together via a strip and three tabs formed therebetween. The first and the second shielding portions are bent from a single flat piece of metal to form a rectangular frame having two opposite edges thereof engaging with each other to enclose the body portion and the tongue portion of the housing, respectively.

2 Claims, 5 Drawing Sheets

ELECTRICAL CONNECTOR

BACKGROUND OF THE INVENTION

1. Field of the Invention

The present invention relates to a connector, and particularly to a mini USB connector including a unitary shell enclosing an insulative housing and a plurality of contacts therein.

2. Description of the Prior Art

As electronic technology advances, electronic products become increasingly smaller and higher speed. During high-speed signal transmission, electromagnetic interference becomes a problem which can seriously affect the quality of the signal transmission. At present, metal shields are often used to reduce the effects of interference. Taiwan Patent Application Nos. 86210437 and 86212282 disclose use of such shielding. However, the shields disclosed in the above Taiwan Patent Applications are generally constructed of two telescopic shells that fit and slide one within the other. The two telescopic shells are separately manufactured and assembled together. Such structures not only reduce the effectiveness of the shielding but also increase the cost of manufacturing the electrical connector because of the assembly required. Hence, an improved electrical connector having a unitary shell is required to overcome the disadvantages of the prior art.

BRIEF SUMMARY OF THE INVENTION

An object of the present invention is to provide a connector including a unitary shell which encloses an insulative housing and a plurality of contacts therein.

To fulfil the above object, an electrical connector of the present invention comprises an insulative housing, a plurality of contacts received in the housing, a unitary shell enclosing the housing and the contacts therein and an insulative cover partially enclosing the shell. The housing includes a body portion and a tongue portion protruding beyond a first face of the body portion. The unitary shell includes a first shielding portion and a second shielding portion connected together via a strip and three tabs formed therebetween. The first and the second shielding portions are bent from a single flat piece of metal to form a rectangular frame having two opposite edges thereof engaging with each other to enclose the body portion and the tongue portion of the housing, respectively.

Other objects, advantages and novel features of the invention will become more apparent from the following detailed description of the present embodiment when taken in conjunction with the accompanying drawings.

DETAILED DESCRIPTION OF THE INVENTION

Figure 1:
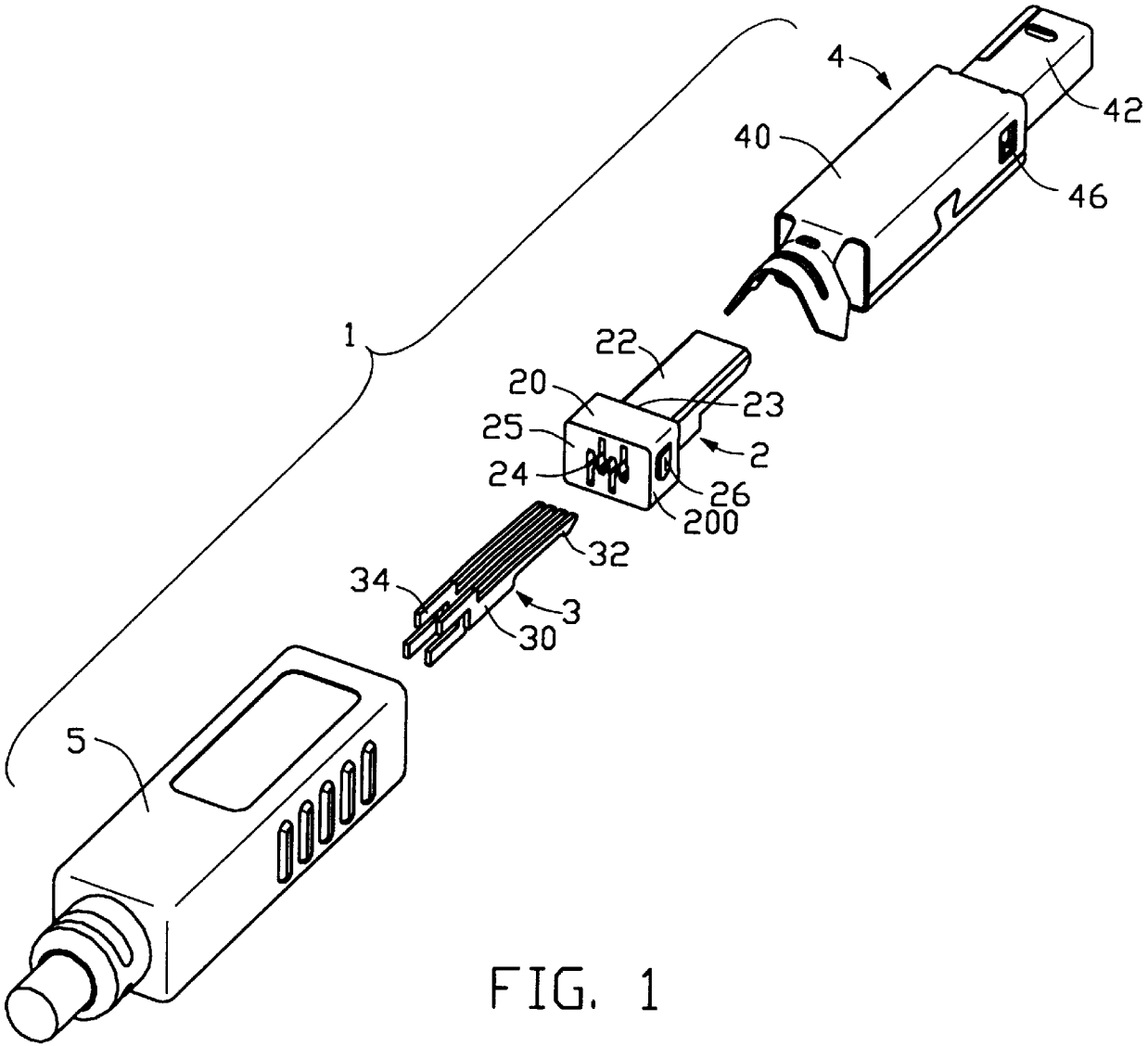
FIG. 1 is an exploded view of an electrical connector in accordance with the present invention.
Figure 2:
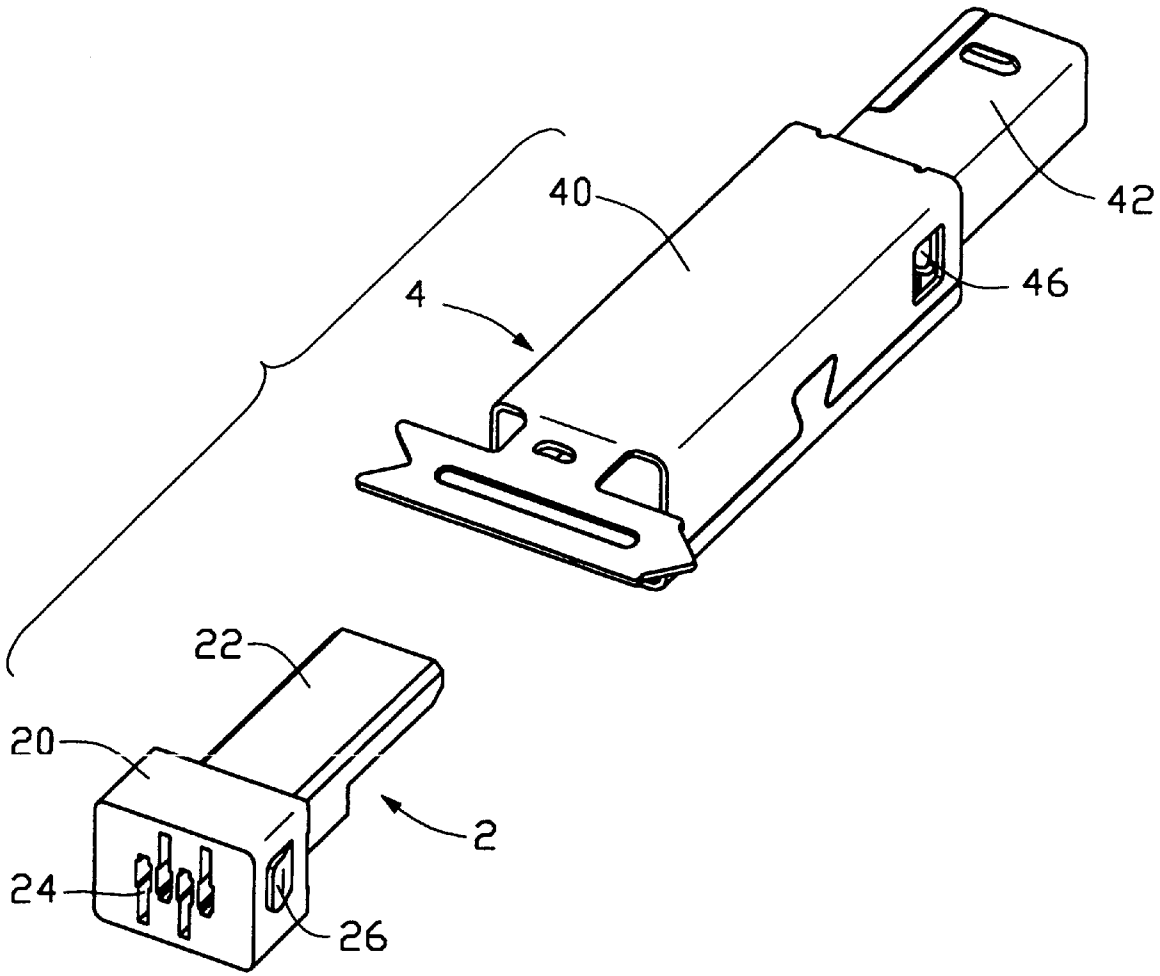
FIG. 2 is a partial enlarged perspective view of FIG. 1 showing an insulative housing being assembled to a unitary shell.
Figure 3:
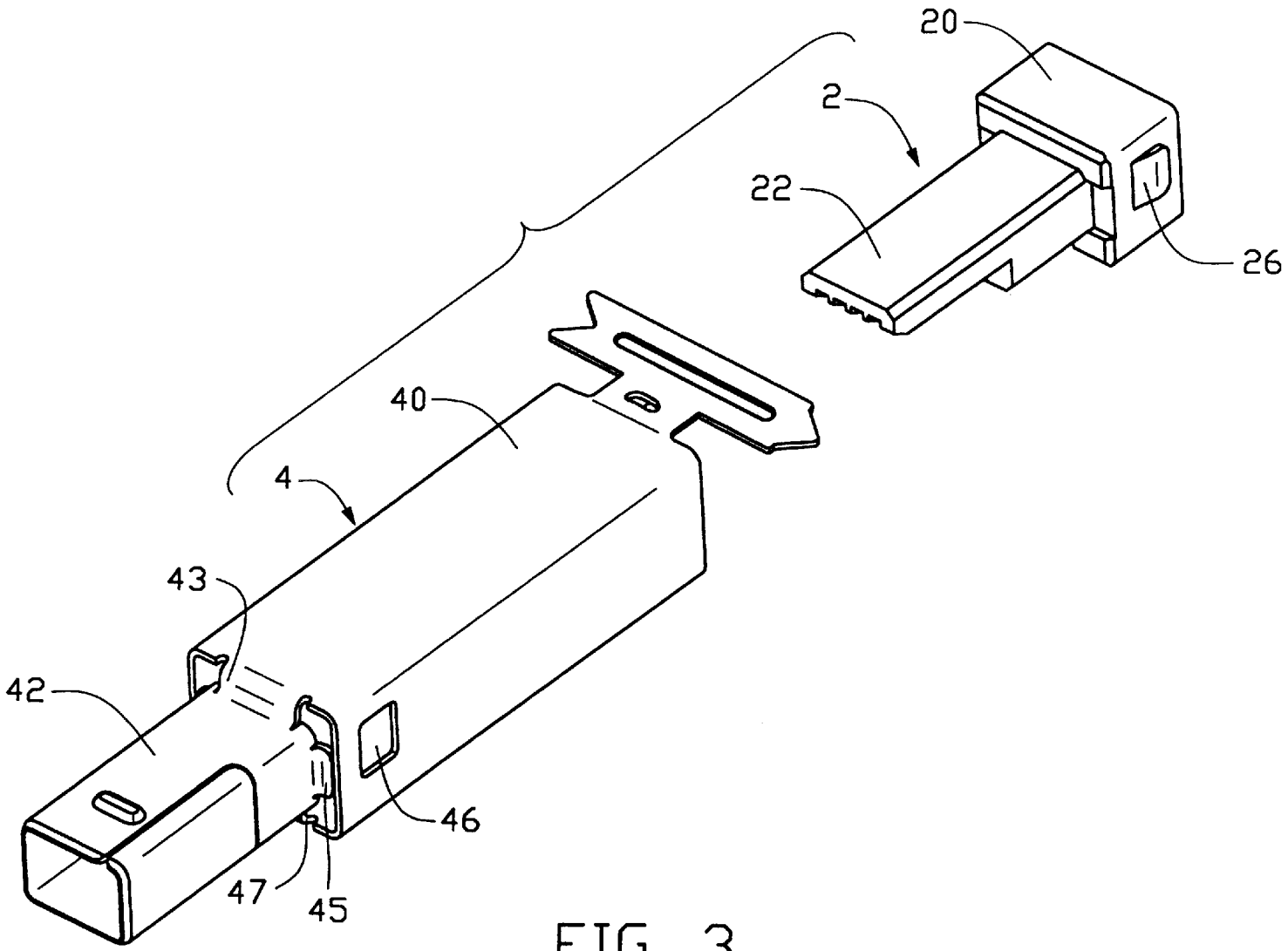
FIG. 3 is similar to FIG. 2 but taken from a different perspective.
Figure 4:
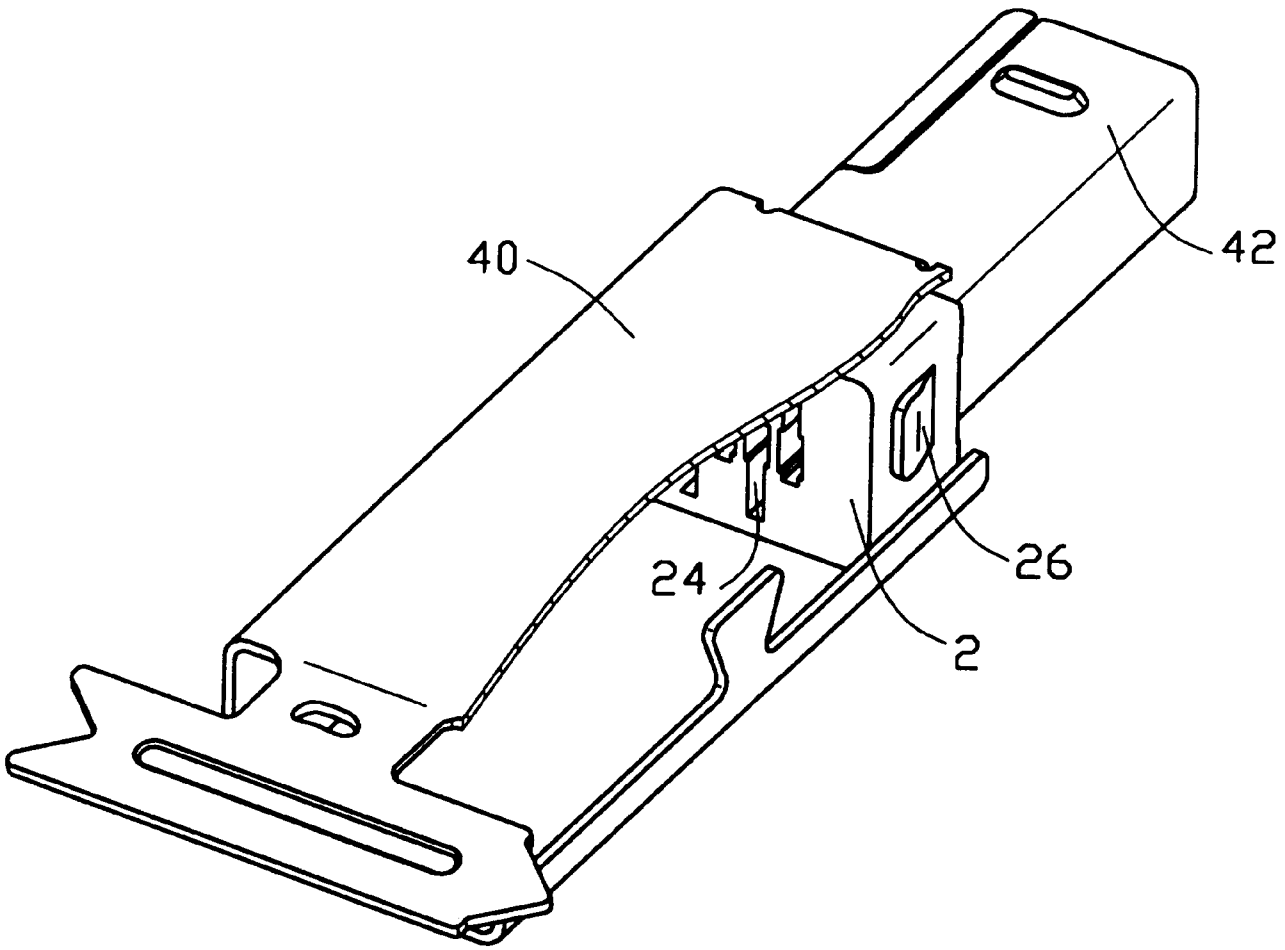
FIG. 4 is a partially cross-sectional assembled view of FIG. 2.
Figure 5:
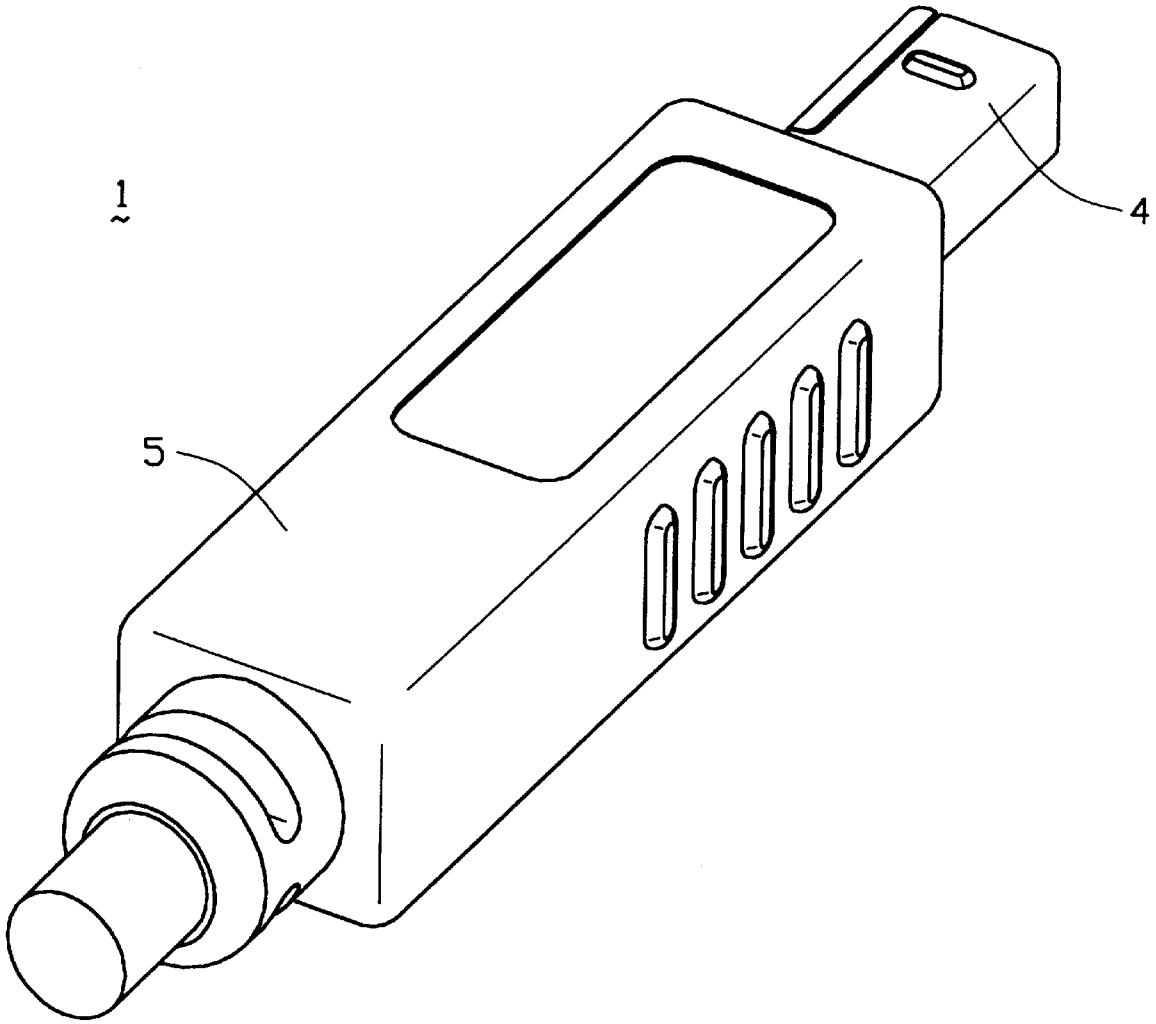
FIG. 5 is a perspective view of the assembled electrical connector of the present invention.

Referring to FIGS. 1–5, an electrical connector 1 in accordance with the present invention comprises an insulative housing 2, a plurality of contacts 3 received in the housing 2, a unitary shell 4 enclosing the housing 2 and the contacts 3 therein and an insulative cover 5 partially insert molded over the unitary shell 4. The housing 2 includes a body portion 20 and a tongue portion 22 protruding beyond a first face 23 of the body portion 20. The housing 2 defines a plurality of apertures 24 through the tongue portion 22 and a second face 25 of the body portion 20 opposing the first face 23. The body portion 20 forms a protrusion 26 in each of two opposite side faces 200 thereof.

Each contact 3 includes a retention portion 30, a mating portion 32 and a tail portion 34. Each contact 3 is received in a corresponding aperture 24 of the housing 2 with the mating portion 32 exposed out of the tongue portion 22 and the tail portion 34 extending beyond the second face 25 of the body portion 20.

The unitary shell 4 includes a first shielding portion 40 and a second shielding portion 42. The first and the second shielding portions 40, 42 are stamped from one piece of metal sheet and are joined together via a strip 43 unitarily stamped and formed therebetween. Then the first and the second shielding portions 40, 42 are bent to respectively form a rectangular frame. The frame of the first shielding portion 40 has two opposite edges which engage with each other at a side of the frame. The frame of the second shielding portion 42 has two opposite edges which engage with each other along a top, a side and a bottom of the frame to obtain a greater strength of the frame. The first shielding portion 40 defines an opening 46 in each of two opposite side faces thereof for receiving the protrusions 26 of the body portion 20 of the housing 2. The first shielding portion 40 forms a first tab 47 protruding from an edge thereof adjacent to the second shielding portion 42 toward the second shielding portion 42 to abut against the second shielding portion 42. The second shielding portion 42 forms a pair of second tabs 45 each protruding from an edge thereof adjacent to the first shielding portion 40 toward the first shielding portion 40 to abut against the first shielding portion 40. The housing 2 having the contacts 3 is assembled tongue portion 22 first into the unitary shell 4 with the body portion 20 and the tongue portion 22 respectively enclosed in the first and the second shielding portions 40, 42, and the protrusions 26 received in the openings 46. The insulative cover 5 is insert molded over the first shielding portion 40, the strip 43, the first and the second tabs 47, 45 and a section of the second shielding portion 42 to strengthen the unitary shell 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing including a body portion and a tongue portion and defining a plurality of apertures therethrough;

a plurality of contacts received in corresponding ones of the apertures of the housing;

a unitary metal shell including a first shielding portion, a second shielding portion and a strip unitarily stamped and bent, the strip being formed between the first and the second shielding portions and joining the first and the second shielding portions together, the first and the second shielding portions substantially entirely enclosing the body portion and the tongue portion of the insulative housing, respectively; and an insulative cover enclosing the unitary shell to partially expose the second shielding portion;

wherein the first shielding portion is bent to form a substantially rectangular first frame having two opposite edges engaged with each other at a side of the frame;

wherein the second shielding portion is bent to form a substantially rectangular second frame having two opposite edges engaged with each other;

wherein the first shielding portion defines a pair of openings in opposite side faces thereof and wherein the body portion of the housing forms a pair of protrusions for engaging with the openings of the first shielding portion;

wherein the insulative cover is molded over the first shielding portion, the strip and a section of the second shielding portion proximate the first shielding portion;

wherein there are three tabs between the first and the second shielding portions, two of the three tabs extending from the second shielding portion to abut the first shielding portion and the other tab extending from the first shielding portion to abut the second shielding portion.

2. An electrical connector comprising:

an insulative housing including a front small housing portion and a rear large housing portion;

a plurality of contacts disposed within the housing;

a unitary shell including a front small shielding portion and a rear large shielding portion with a strip integrally formed between and joining both the front small shielding portion and the rear large shielding portion; and means for retainably radially restraining the front small shielding portion with regard to the rear large shielding portion so as to assure alignment the front small shielding portion and the rear large shielding portion with each other axially;

wherein said means includes at least one tab integrally extending from one of the front small shielding portion and the rear large shielding portion to abut against the other of the front small shielding portion and the rear large shielding portion for confinement of the front small shielding portion relative to the rear large shielding portion in a radial direction;

wherein the housing defines at least one recess for receiving said at least one tab therein;

further including securing means for securing the shell to the housing;

wherein said securing means includes at least an opening in the rear large shielding portion and at least a protrusion on the rear large housing portion which is received in said opening.

* * * * *